US006585077B2

(12) United States Patent
Vincenot et al.

(10) Patent No.: US 6,585,077 B2
(45) Date of Patent: Jul. 1, 2003

(54) SOUND-PRODUCING DEVICE WITH ACOUSTIC WAVEGUIDE

(76) Inventors: Eric Vincenot, 1 á 5 rue Pixerecourt, Paris (FR), 75020; François Deffarges, 42 Terrasse de l'Iris, Courbevoie (FR), 92400

( * ) Notice: Subject to any disclaimer, the term of this patent is extended or adjusted under 35 U.S.C. 154(b) by 0 days.

(21) Appl. No.: 09/948,662

(22) Filed: Sep. 10, 2001

(65) Prior Publication Data

US 2002/0029926 A1 Mar. 14, 2002

(30) Foreign Application Priority Data

Sep. 8, 2000 (FR) ..... 00 11496

(51) Int. Cl.[7] ..... G10K 11/00
(52) U.S. Cl. ..... 181/192
(58) Field of Search ..... 181/192, 177, 181/181, 182, 185, 187, 193, 194, 195

(56) References Cited

U.S. PATENT DOCUMENTS

| | | | | | |
|---|---|---|---|---|---|
| 2,643,727 A | | 6/1953 | Leon | | |
| 4,033,431 A | | 7/1977 | Ebejer | | |
| 4,235,301 A | * | 11/1980 | Mitchell | ..... | 181/148 |
| 5,716,254 A | * | 2/1998 | Bowes | ..... | 446/397 |
| 5,889,876 A | * | 3/1999 | Billings | ..... | 181/144 |
| 5,900,593 A | | 5/1999 | Adamson | | |

FOREIGN PATENT DOCUMENTS

| | | |
|---|---|---|
| DE | 34 39 996 | 6/1986 |
| FR | 528 154 | 11/1921 |

* cited by examiner

*Primary Examiner*—Kim Lockett
(74) *Attorney, Agent, or Firm*—Young & Thompson

(57) ABSTRACT

A sound-producing device includes an acoustical generator associated with a rigid acoustical waveguide. The waveguide has a first section aligned with the exit and a second section aligned with the entry and the two sections are connected by a curved reflecting surface having the shape of part of a conic section surface.

13 Claims, 3 Drawing Sheets

FIG. 1
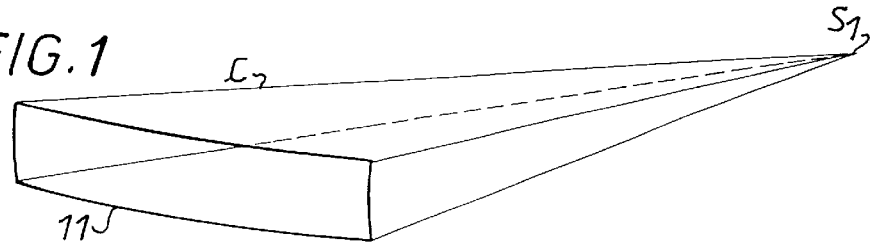
FIG. 2
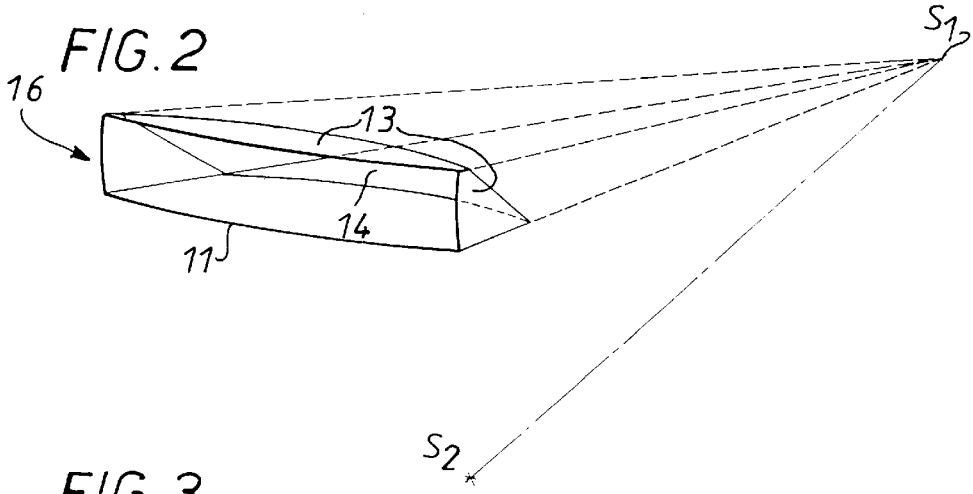
FIG. 3
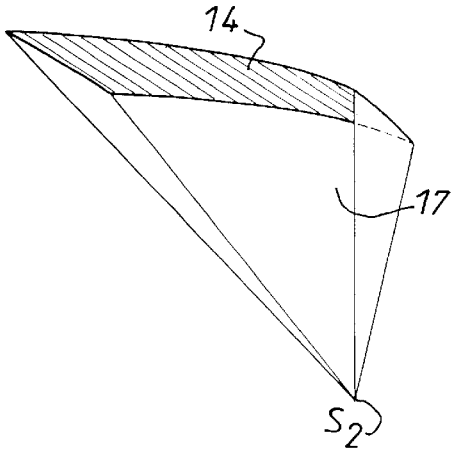
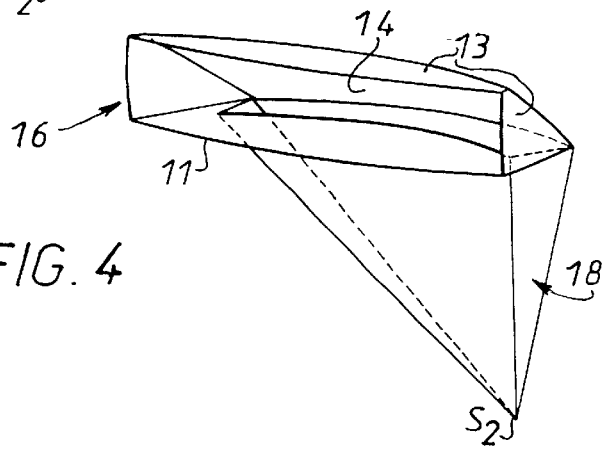
FIG. 4

SOUND-PRODUCING DEVICE WITH ACOUSTIC WAVEGUIDE

BACKGROUND OF THE INVENTION

1. Field of the Invention

The invention relates to a sound-producing device including an acoustical waveguide and an acoustical generator coupled to said waveguide.

It applies to all electroacoustical fields, including high fidelity.

The invention is more particularly concerned with the shape of the waveguide forming the acoustical horn with the aim of obtaining good control of the dispersion of the sound by means of a relatively compact and in particular relatively shallow system.

2. Description of the Prior Art

In producing sound, good control of the dispersion of the sound by an acoustical generator conventionally imposes the use of a horn forming a large acoustical waveguide. Consequently, a box forming an acoustical enclosure and enclosing at least an acoustical generator and its waveguide is generally bulky, and in particular relatively deep, since the depth of said acoustical enclosure depends essentially on the length of the horn.

French patent No. 88-02481 defines an acoustical generator associated with an acoustical waveguide. Obstacles between the entry and the exit of the waveguide are shaped to homogenize the acoustical paths between the entry and the exit of the waveguide. The wavefront obtained is rectangular and has a straight profile.

U.S. Pat. No. 5,900,593 uses similar principles but additionally a mirror in the form of a curved dihedron of circular arc shape adapted to modify the sound propagation direction. The wavefront obtained is rectangular and has a convex profile.

A first object of the invention is to form an acoustical wavefront of chosen shape and having a convex, concave or plane profile by means of a small waveguide.

Coupling a plurality of conventional sound-producing devices leads to irregularities in the dispersion of the sound due to the occurrence of acoustical interference between the sound waves issuing from the various waveguides.

A second object of the invention is to propose an arrangement of sound-producing devices enabling several devices to be coupled together in such a manner as to allow good control of the shape of the acoustical wavefront emitted by the set of acoustical generators without creating troublesome interference.

The invention is based on the principles of geometrical acoustics, i.e. the field of acoustics based on ray theory. It therefore applies laws known from optics to the propagation of sound, in particular the laws of reflection of rays from conic section surfaces. By "conic section surface" is meant a surface generated by rotating a curve from the conic family. More particularly, in the context of the invention, advantageous acoustical properties have been discovered and put to use that are associated with acoustical reflections from surfaces such as hyperboloids, paraboloids or ellipsoids.

The basic principle of the invention resides in the fact that using a reflection surface of the above kind as an acoustical mirror makes it possible to displace the apparent point of emission of a sound source.

SUMMARY OF THE INVENTION

The invention relates more particularly to a sound-producing device including at least one acoustical generator and an acoustical waveguide provided with an entry to which the acoustical generator is connected and an exit of chosen shape from which an acoustical wave propagates to the outside, wherein the waveguide includes two duct sections, namely a first section aligned with the exit and a second section aligned with the inlet, the two sections are connected partly by a curved reflecting surface having substantially the shape of part of a conic section surface, and the entry is defined in the vicinity of a focus of said conic section surface.

Note that the waveguide as described can be perfectly extended by another horn.

The interior volume of the first section is preferably substantially delimited by the intersections of:

the surface of the exit, a first lateral surface generated by a generatrix passing through a first focus of the conic section surface and resting on the contour of the exit, and the curved reflecting surface delimited inside a contour defined by the intersection of the conic section surface and the first lateral surface.

Similarly the internal volume of the second section is substantially delimited by the intersection of a second lateral surface generated by a generatrix passing through a second focus of the conic section surface and resting on the contour of the reflecting surface and the reflecting surface itself, excluding the volume portion shared with the first section.

In defining said first and second sections, it amounts of course to totally the same thing to consider that the internal volume of the second section includes the common portion and that the latter is subtracted from the internal volume of the first section. The geometrical definition of the first and second sections of the acoustical waveguide is no more than a convenient means of describing the overall shape of the internal volume of the waveguide.

The inlet is defined in the vicinity of the second focus. Because the sound source cannot be a point source, the second section includes, in the vicinity of the second focus, a widened mouth connected to the second lateral surface. The mouth has a shape and dimensions suited to the attached acoustical generator.

If the conic section surface is a hyperboloid, it is just as if the sound were emitted from the first focus, which is to the rear of and at a distance from the component parts of the device. Accordingly, in this case, the depth of a sound-producing device can be significantly reduced compared to what it would be if an acoustical horn were entirely formed between the first focus and the aforementioned exit. What is more, this configuration facilitates coupling a plurality of similar devices in order to emit a convex wavefront without creating interference between the sources.

If a paraboloid is used, the first focus is projected to infinity behind the mirror and the acoustical wavefront is plane. This type of emission is equally beneficial for homogenizing sound propagation in a room and for achieving good coupling between a plurality of sources without interference.

Finally, if the mirror is a portion of an ellipsoid, the first focus is shifted to the front of the opening so that the sound appears to be created at a given point in the listening room. The wavefront is concave. A plurality of similar devices can likewise be coupled without interference, producing the effect of a virtual sound source in the listening room.

The invention will be better understood and other advantages of the invention will become more clearly apparent in the light of the following description of various embodiments of a sound-producing device according to the invention, which description is given by way of example only and with reference to the accompanying drawings.

BRIEF DESCRIPTION OF THE DRAWINGS

FIGS. 1 to 4 are diagrams showing steps in the design of a waveguide according to the invention.

DETAILED DESCRIPTION OF THE PREFERRED EMBODIMENTS

Figure 5:
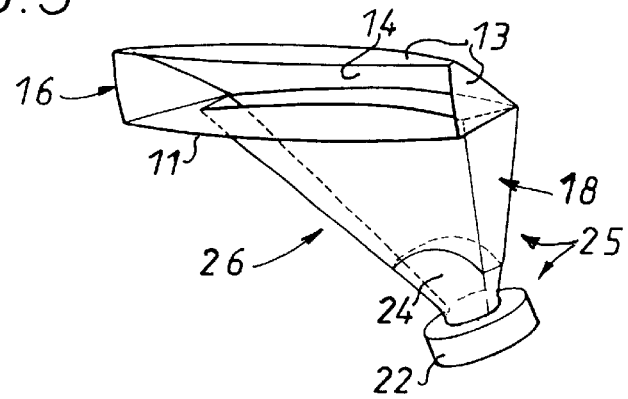
FIG. 5 shows a sound-producing device equipped with a first type of waveguide according to the invention.

FIG. 1 shows an exit 11 of defined shape of an acoustical waveguide not yet defined. In this example, this exit, through which the sound must radiate to an audience, has an approximately rectangular contour, but is preferably inscribed on the surface of a sphere. The exit of the waveguide is therefore preferably inscribed on a convex spherical surface. The center of the sphere is denoted $S_1$ in FIG. 1. The radius of the sphere is chosen by the skilled person so that the acoustical horn C between the center $S_1$ where the acoustical generator is placed and the exit 11 is sufficiently long to ensure good control of the directionality of the sound projected beyond the exit 11. FIG. 1 shows the theoretical shape of a horn of this kind and it is to be understood that the sound-producing device that would result from a combination of a horn of this kind and an acoustical generator placed at the point $S_1$ would be relatively bulky, in particular in the depthwise direction.

This is why the choice is made to "truncate" that volume by placing between the exit 11 and the point $S_1$ a curved reflecting surface having substantially the shape of part of a conic section surface. Moreover, the conic section surface is chosen so that one of its foci is at the point $S_1$. The remainder of the text refers to the focus $S_1$ and it must be borne in mind that the focus is also the center of an imaginary sphere, as defined above. Thus a part of the real duct constituting the waveguide has been defined, to be more specific a first section 16 in line with the exit 11 and whose internal volume is substantially delimited by the intersections of:

the surface of the exit 11, a first lateral surface 13 generated by a rectilinear generatrix passing through the first focus of the conic section and bearing on the contour of the exit 11 (this first lateral surface 13 is clearly coincident with that of the theoretical horn C defined above), and the curved reflecting surface 14 itself, which is a portion of a conic section surface and is delimited inside a contour defined by the intersection of that conic section surface and the first lateral surface 13.

In the FIG. 1 example, the chosen conic section surface is a hyperboloid. As previously indicated, a first focus of the hyperboloid is coincident with the point $S_1$ (the characteristics of the hyperboloid are calculated accordingly). The position of the second focus $S_2$ of the hyperboloid is defined by the position of the first focus and the characteristics of the hyperboloid. It is shown in FIG. 2. The second focus $S_2$ faces the concave face of the hyperboloid reflecting surface 14. The straight line segment $S_1$, $S_2$ is the axis of revolution of the hyperboloid. From this point and from the surface 14 of the hyperboloid portion defined in the construction of FIG. 2 it is possible to define a volume represented in FIG. 3 which is substantially delimited by the intersections of the reflecting surface 14 and a second lateral surface 17 generated by a rectilinear generatrix passing through the second focus $S_2$ of the conic section surface (hyperboloid) and bearing on the contour of the reflecting surface 14 previously delimited. Subtracting its portion shared with the first duct section 16 defined above from this volume defines the second duct section 18 of the waveguide, which is globally in line with the entry of the waveguide, defined in the vicinity of the second focus $S_2$. The internal volume and the shape of the waveguide are therefore theoretically determined by the combination of the first and second sections 16 and 18. This is represented globally in FIG. 4. In theory, if an acoustical generator is placed at the point $S_2$ (i.e. the aforementioned second focus of the curved reflecting surface 14 which is part of a hyperboloid), it is just as if the sound were emitted from the point $S_1$, with an acoustical horn C (see FIG. 1).

Note that it is advantageous to place the conic section surface so that the surface 14 is relatively close to the surface containing the exit 11. Under these conditions the first section 16 can be made as short as possible.

In a simplified version, the convex surface exit 11, which is ideally inscribed on the surface of a sphere with center $S_1$, can in fact be relatively plane, provided that the chosen diameter of the sphere is relatively large. Even with this approximation, the internal volume of the duct constituting the waveguide is determined as indicated above.

It is nevertheless necessary to adapt the end of the second lateral surface 17 in the vicinity of the second focus $S_2$ to take account of the dimensional characteristics of the acoustical generator. This is why this part of the second lateral surface 17 is modified to suit an acoustical generator 22. To this end, the second section includes, in the vicinity of the second focus, a widened mouth 24 joined to the rest of the second lateral surface. The shape and the dimensions of the mouth are suited to the acoustical attached generator 22. FIG. 5 shows the complete sound-producing device 25. It is made up of the waveguide 26 (consisting of the first and second sections 16, 18 and the mouth 24) and the acoustical generator 22 connected to the widened mouth 24. The waveguide 26 is molded or injection molded if its walls are sufficiently rigid. In theory it is above all important that the conic section surface portion be made from an acoustically reflective material, but in practice all the walls of the waveguide are made from the same material. The wavefront emiffed is convex.

In practice, the device just described can be used on its own or integrated into a box forming an acoustical enclosure. In this case, it is clear from comparing FIGS. 1 and 5 that the dimensions of the box, in particular its depth, are smaller than would be necessary with a horn C forming a waveguide conforming to FIG. 1. The rest of the box can be adapted to accommodate one or more complementary loudspeakers.

Figure 6:
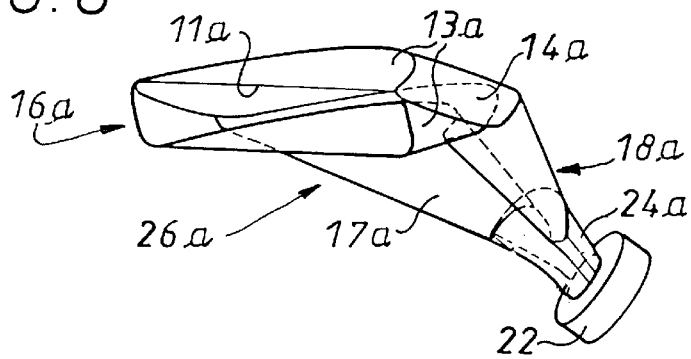
FIG. 6 is a view analogous to FIG. 5 showing a sound-producing device equipped with a second type of waveguide according to the invention.

In the FIG. 6 device, the waveguide 26*a* has an approximately rectangular exit 11*a,* in this instance with rounded corners, associated with a curved reflecting surface 14*a* having substantially the shape of part of a paraboloid. The limits of the reflecting surface 14*a* are determined in the same manner as previously, assuming that the first focus is now projected to infinity.

Consequently, the first lateral surface 13*a* is generated by a generatrix perpendicular to the plane surface of the exit 11*a* and moving parallel to itself bearing on the contour of that exit. The second focus, in the vicinity of which the entry of the waveguide and therefore the generator 22 is to be placed, is in fact the single focus of the paraboloid. The second focus, close to the generator 22, faces the concave face of the paraboloid reflecting surface 14*a*. The internal volume of the second section 18*a* is, as previously, substantially delimited by the intersections of a second lateral surface 17*a* generated by a generatrix passing through the second focus and bearing on the contour of the reflecting surface 14*a* excluding, of course, the volume portion shared with the first section 16*a*.

As previously, the reflecting surface 14*a* is placed as close as possible to the exit; it can be seen that it is "flush" with two of its rounded corners. The second lateral surface 17*a* has a concave face (toward the front) and a convex face (toward the rear).

As previously indicated, the widened mouth 24*a* is defined at the end of the second lateral surface 17*a* so that it can be joined to the acoustical generator 22. The wavefront emitted is plane.

Figure 7:
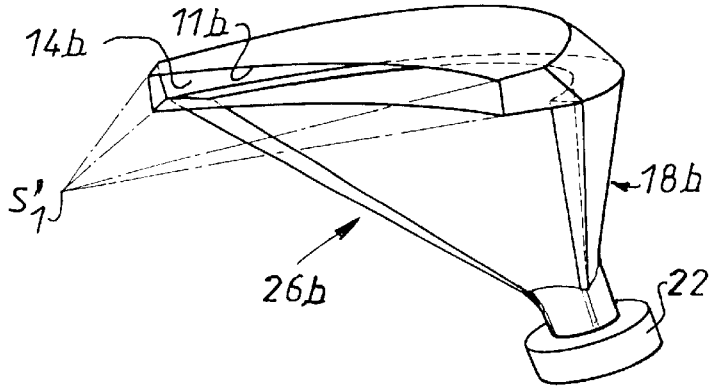
FIG. 7 is a view analogous to FIG. 5 showing a sound-producing device equipped with a third type of waveguide according to the invention.

In the FIG. 7 embodiment, structural elements similar to those of the FIG. 5 embodiment are identified by the same reference numbers with the suffix b. They are not described in detail again.

In this example, the exit 11*b* of the waveguide 26*b* is ideally inscribed on the surface of a sphere whose center $S'_1$ is in the listening area. In this case, the center of the theoretical sphere constitutes one focus of the conic section which defines the reflecting surface 14*b* and that conic section surface is an ellipsoid.

Of course, as in the case of FIG. 5, a practically plane exit can be designed if the radius of the sphere is made large enough. Otherwise the construction of the volume of the waveguide is identical to that explained with reference to FIGS. 1 to 5. The acoustical generator 22 is placed in the vicinity of the second focus of the ellipsoid. The wavefront emitted is concave and it is just as if the sound were generated at a point $S'_1$ in the listening area reserved to the audience. The first focus $S'_1$ is therefore in front of the exit 11*b*. As previously, the waveguide and the acoustical generator can be accommodated inside a box forming an acoustical enclosure.

Figure 8:
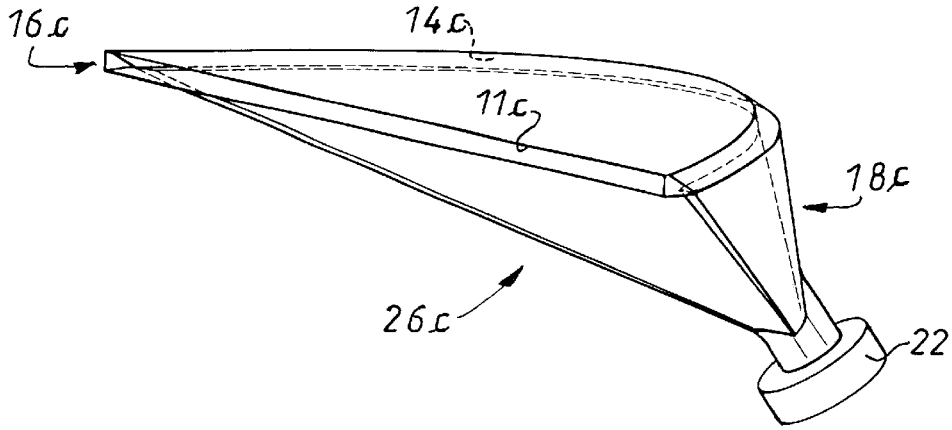
FIG. 8 is a variant of FIG. 5.
Figure 9:
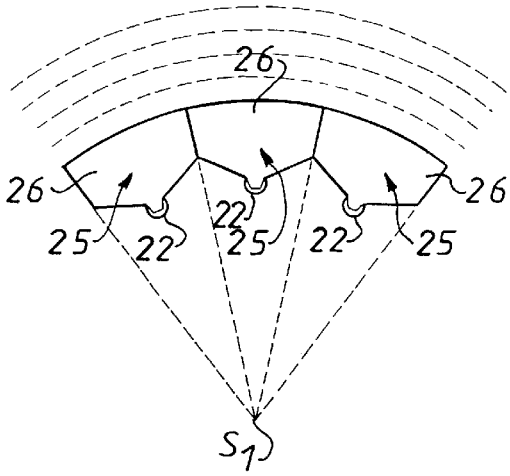
FIG. 9 is a diagram showing the coupling without interference of a plurality of sound-producing devices of the type shown in FIG. 5.
Figure 10:
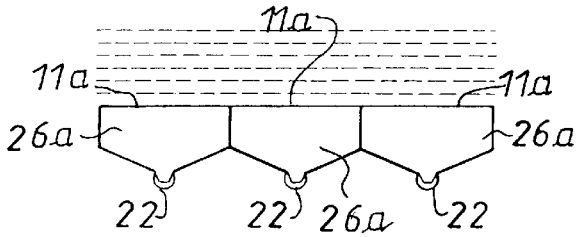
FIG. 10 is a diagram showing the coupling of a plurality of sound-producing devices of the type shown in FIG. 6.
Figure 11:
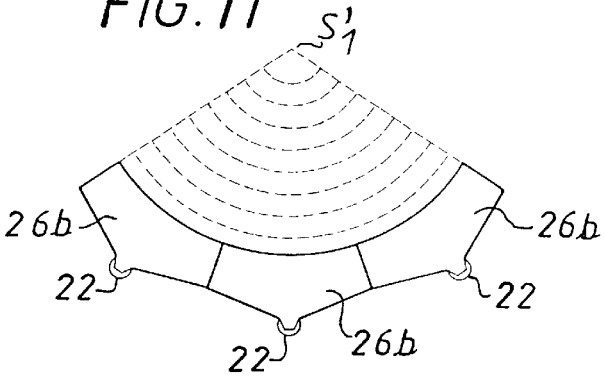
FIG. 11 is a diagram showing the coupling of a plurality of sound-producing devices of the type shown in FIG. 7.

FIGS. 8 to 10 show more particularly the possibility of coupling a plurality of sound-producing devices according to the invention without interference. Thus FIG. 8 shows the coupling of three sound-producing devices 25 (shown from above). In other words, the overall sound-producing device includes a plurality of units each of which is formed of an acoustical generator 22 and an associated waveguide 26. In the FIG. 8 example, each unit is made up of a device as described with reference to FIG. 5. For such units to be combined without causing interference, it is sufficient for them to be positioned relative to each other so that the corresponding first foci $S_1$ are substantially coincident. FIG. 8 shows this. In this case, all of the units appear to emit from the same point $S_1$ to their rear.

In the FIG. 9 example the device is made up of a plurality of units each of which is formed of an acoustical generator 22 and an associated waveguide 26*a* conforming to the device described with reference to FIG. 6, i.e. with a reflecting surface consisting of part of a paraboloid. The units are positioned side-by-side so that the exits (defined in plane surfaces) are substantially aligned and therefore coplanar. In this case, all the acoustical generators substantially positioned at the focus of a reflecting surface in the form of a paraboloid are themselves aligned.

In the FIG. 10 embodiment the device is made up of three units each formed of an acoustical generator 22 and an associated waveguide 26*b* as shown in FIG. 7, i.e. including a reflecting surface inscribed on an ellipsoid. The three units are positioned side-by-side so that the corresponding first foci are substantially coincident at a point $S'_1$ of the listening area at which the sound appears to be reproduced.

Of course, each unit can be integrated into a box which is shaped so that the required conditioning is obtained by juxtaposition of lateral walls of such boxes.

What is more, in each of the cases shown in FIGS. 5 to 7, if the smallest dimension of the exit becomes small in comparison to the wavelengths of the sounds produced, the reflecting surface defined by a portion of a conic section tends toward a strip, or even a line, defined by a portion of the corresponding conic section curve, namely a hyperbola in the case of FIG. 5, a parabola in the case of FIG. 6 or an ellipse in the case of FIG. 7. A waveguide in which the reflecting surface is produced in this way so that it tends towards its generating curve is shown in FIG. 8 in which similar structural elements are identified by the same reference numbers with the suffix c. In FIG. 8 the surface of the conic section is reduced to a thin strip of reflecting surface 14*c* which is substantially a hyperboloid.

What is claimed is:

1. A sound-producing device including at least one acoustical generator and an acoustical waveguide provided with an entry to which said acoustical generator is connected and an exit of chosen shape from which an acoustical wave propagates to the outside, wherein said waveguide includes two duct sections, namely a first section aligned with said exit and a second section aligned with said entry, said two sections are connected partly by a curved reflecting surface having substantially the shape of part of a conic section surface, and said entry is in a vicinity of a focus of said conic section surface.

2. The device claimed in claim 1 wherein the interior volume of said first section is substantially delimited by the intersections of:

the surface of said exit, a first lateral surface generated by a generatrix passing through a first focus of said conic section surface and resting on the contour of said exit, and said curved reflecting surface delimited inside a contour defined by the intersection of said conic section surface and said first lateral surface.

3. The device claimed in claim 2 wherein the internal volume of said second section is substantially delimited by the intersection of a second lateral surface generated by a generatrix passing through a second focus of said conic section surface and resting on said contour of said reflecting surface and said reflecting surface itself, excluding the volume portion shared with said first section.

4. The device claimed in claim 3 wherein said second section includes, in the vicinity of said second focus, a widened mouth connected to said second lateral surface and having a shape and dimensions suited to the attached acoustical generator.

5. The device claimed in claim 1 wherein said conic section surface is a hyperboloid and said second focus near said generator faces the concave face thereof.

6. The device claimed in claim 1 wherein said conic section surface is an ellipsoid and said first focus is in front of said exit.

7. The device claimed in claim 5 wherein the contour of said exit is substantially inscribed on the surface of a sphere whose center is coincident with said first focus.

8. The device claimed in claim 6 wherein the contour of said exit is substantially inscribed on the surface of a sphere whose center is coincident with said first focus.

9. The device claimed in claim 1 wherein said conic section surface is a paraboloid, said first focus is projected to infinity and said second focus is close to said generator and faces the concave face of said reflecting surface.

10. The device claimed in claim 5 including a plurality of units each formed of an acoustical generator and an associated waveguide and wherein said units are positioned relative to each other so that the corresponding first foci are substantially coincident.

11. The device claimed in claim 9 including a plurality of units each formed of an acoustical generator and an associated waveguide and wherein said units are positioned so that said exits are substantially aligned.

12. The device claimed in claim 10 wherein each unit is integrated into a box conformed so that the required positioning of said units is achieved by juxtaposition of lateral walls of said boxes.

13. The device claimed in claim 11 wherein each unit is integrated into a box conformed so that the required positioning of said units is achieved by juxtaposition of lateral walls of said boxes.

* * * * *